United States Patent [19]

Rude

[11] 4,303,238

[45] Dec. 1, 1981

[54] DIVING BOARD WITH ENHANCED TIP PERFORMANCE

[75] Inventor: Raymond C. Rude, Reno, Nev.

[73] Assignee: Arcadia Air Products, Sparks, Nev.

[21] Appl. No.: 876,208

[22] Filed: Feb. 9, 1978

[51] Int. Cl.[3] ..... A63B 5/08

[52] U.S. Cl. ..... 272/66

[58] Field of Search ..... 272/66, 65, 109, DIG. 4; 273/DIG. 1

[56] References Cited

U.S. PATENT DOCUMENTS

| | | | |
|---|---|---|---|
| 2,652,966 | 9/1953 | Griswold | 272/65 |
| 2,864,616 | 12/1958 | Rude | 272/66 |
| 3,072,401 | 1/1963 | Rude | 272/66 |
| 3,647,211 | 3/1972 | Doessel et al. | 273/DIG. 1 X |

*Primary Examiner*—Richard C. Pinkham
*Assistant Examiner*—William R. Browne
*Attorney, Agent, or Firm*—Christie, Parker & Hale

[57] ABSTRACT

A diver's springboard comprises a top plate having a flat upper surface which extends between a base end and a tip end of the board. A plurality of longitudinally extending, spaced parallel ribs are connected to the underside of the top plate and define a plurality of downwardly opening longitudinal spaces. The ribs are displaced outwardly from either side of a longitudinal centerline of the top plate. An upwardly opening channel-shaped torsion brace is anchored to the underside of the top plate and extends longitudinally of the top plate between the innermost ones of the ribs. A plurality of elongate openings are formed through the top plate in a selected area of the top plate upper surface which extends from a location proximately adjacent to the tip end of the board for a selected distance along the board toward its base end. The openings are formed through the top plate between the innermost ribs and the longitudinal edges of the top plates. The openings have their elongate extents aligned parallel to the centerline.

11 Claims, 8 Drawing Figures

DIVING BOARD WITH ENHANCED TIP PERFORMANCE

BACKGROUND OF THE INVENTION

Field of the Invention

This invention concerns diving boards. More particularly, it concerns diving boards having holes formed therethrough adjacent the tip of the board to reduce the air resistance of the tip in use and to make the board safer to use.

Review of the Prior Art

My prior U.S. Pat. No. 2,864,616 describes a metal springboard, for divers and the like, which provides the environment in which I prefer to practice this invention.

Springboards constructed in accord with U.S. Pat. No. 2,864,616 are used widely by skilled divers in competition and in practice for competition; such springboards have been used exclusively in all major international diving events since 1959, including the Olypmic Games and Pan American Games. These springboards are constructed essentially entirely of metal, preferably of aluminum, and are characterized by their uniform properties, and their superior spring characteristics and deflection range which enables an experienced competition diver to obtain better lift from them. The greater the lift which a diver can obtain from a board set at any given height (usually one meter or three meters), the longer the time the diver has to perform the actual maneuvers of the dive and to achieve a proper entrance into the water.

In order that a diver can obtain the maximum lift from a diving board, the board should respond, to the greatest extent possible, to the motions of the diver in his approach and take off from the board. The diver should not have to adjust his pace or motion to the dynamic properties or other characteristics of the board. The tip of the board should respond immediately and as fully as possible to the final downward loading of the board at its tip end by the diver prior to take off; it is at this time that the tip of the board flexes farthest down and then rebounds upwardly to propel the diver from the board, and it is at this time that the tip of the board moves fastest downwardly and upwardly. The faster and the farther downwardly the board tip moves, and the faster the tip rebounds upwardly, the greater the lift produced by the board.

In competition diving, the vertical motions of a diving board are so great and so rapid that aerodynamic drag effects can damp and reduce the desired motions which the diver could otherwise produce in the board. Drag effects impair the ability of the diver to get the most lift possible from the board.

Current rules pertinent to competition diving require that the board be mounted to be flat, i.e., level, as opposed to sloped. In diving competition, a series of divers use a given board repeatedly in a short time. As a result, the board surface becomes wet. A wet diving board can become slippery. Accordingly, non-skid surfacing materials or treatments are applied to the upper surfaces of diving boards for reasons of safety. While such surfacing materials and treatments do effectively reduce the slipperiness of a wet board, there is still room for improvement.

A need is therefore seen to exist, particularly in the context of diving boards used in competitions, for a diving board which has minimum susceptibility to aerodynamic drag and which reduces the hazards of a wet board surface. An effective response to this need should produce a diving board with which a user can feel comfortable and relaxed, rather than apprehensive and unsure.

SUMMARY OF THE INVENTION

This invention effectively addresses and fills the need described above by providing a diver's springboard in which aerodynamic drag effects are reduced, and drainage of water from the board and user traction on the board are increased. These advantages are provided by simple and effective structural improvements in the board. The improvements reside principally in the presence of a plurality of openings in the board in a selected area of the board adjacent its tip end where motions of the board are greatest during use. It is the 18 inches or so of the length of the board at its tip which becomes slippery first, due to the stopping and turning movements of the divers.

Generally speaking, this invention provides a diver's springboard (a diving board) having a substantially flat upper tread surface which extends from a base end to a tip end of the board. The board also has a bottom surface. The diving board is characterized by the presence in the board of a plurality of openings which are formed through the board in a selected area which extends from a location proximately adjacent the tip end of the board toward the base end of the board for a distance which is less than about one-half the length of the board. The openings are formed through the board so as to open to the upper and bottom surfaces of the board. The openings are elongated in the direction of the elongate extent of the board.

DESCRIPTION OF THE DRAWINGS

The above-mentioned and other features of this invention are more fully set forth in the following detailed description of a presently preferred embodiment of this invention, which description is presented with reference to the accompanying drawings, wherein.

DESCRIPTION OF THE ILLUSTRATED EMBODIMENTS

FIGS. 1, 2, 3 and 4 show a metal springboard according to this invention. The springboard has a rear base end 11 and a forward tip end 12. As shown in U.S. Pat. No. 2,864,616, in use of the springboard its base end is connected to a suitable transverse horizontal anchor member and the underside of the board forwardly of its base end, but short of its midlength, is supported by a horizontal fulcrum member so that the board, between the fulcrum member and the tip end of the board, is supported in cantilever fashion.

Figure 3:
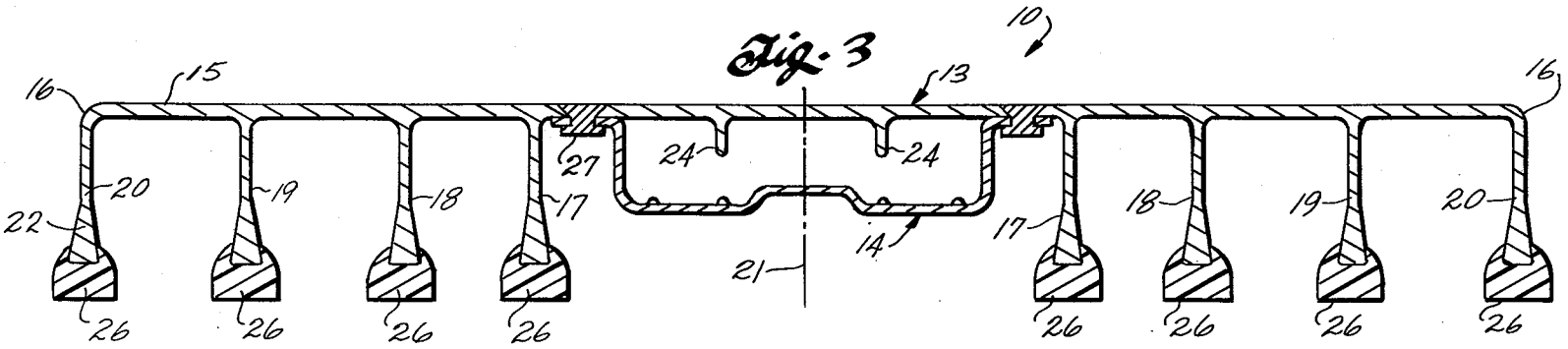
FIG. 3 is a cross-sectional elevation view taken along line 3—3 in FIG. 1.
Figure 4:
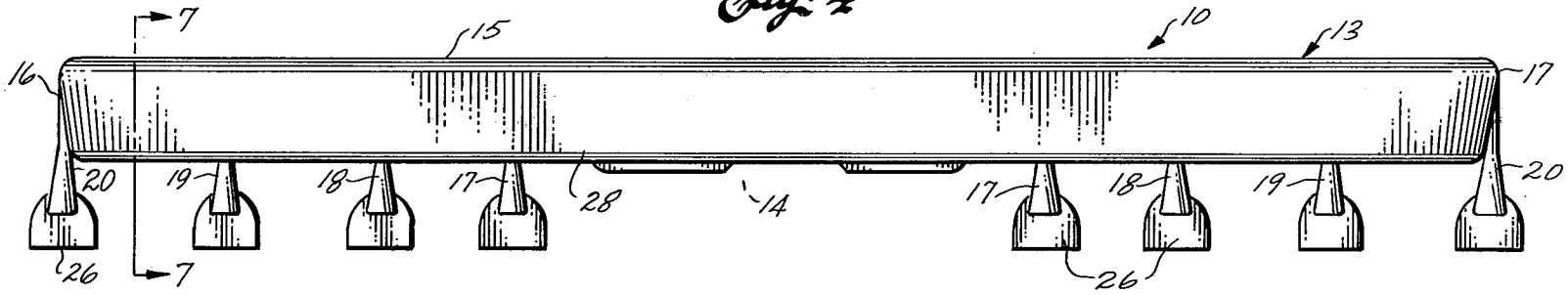
FIG. 4 is an elevation view of the tip end of the springboard taken along line 4—4 in FIG. 1.
Figure 5:
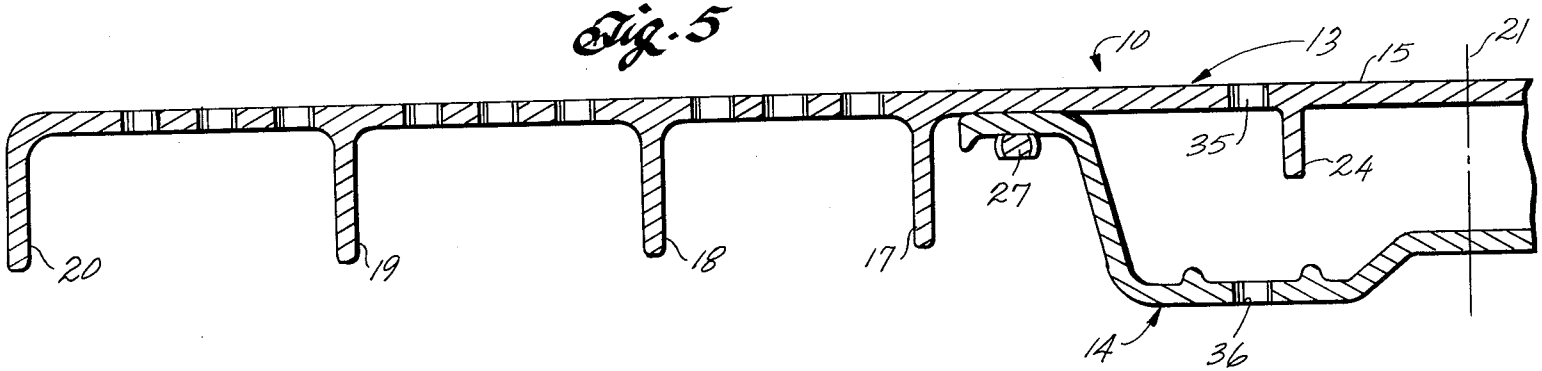
FIG. 5 is a fragmentary enlarged cross-sectional elevation view taken along line 5—5 in FIG. 1.

As shown best in FIGS. 3 and 5, the springboard is composed principally of a top plate 13 and a torsion brace 14 which, in cross-section, is of shallow channel shape. The top plate extends along the entire length of the springboard from the base end to the tip end, and has a flat upper surface 15. The top plate is of substantially uniform thickness along its length and along its width between opposite longitudinal edges 16 of the springboard. A plurality of major ribs 17, 18, 19 and 20 extend from the underside of the top plate, perpendicular to the plane of the top plate, in parallel relation to each other and to a vertical centerplane 21 of the board about which the board is symmetrical. Ribs 17, 18, 19 and 20 are arranged in two sets of ribs, one on each side of centerplane 21, with ribs 17 being innermost ribs closest to the centerplane and ribs 20 being the outermost ribs disposed along and defining the longitudinal edges of the springboard. As shown in FIG. 3, the ribs are of uniform depth along a line perpendicular to the undersurface of the top plate. The ribs are bulbed or enlarged at their lower ends, as at 22. Preferably, ribs 17, 18, 19 and 20 are formed integral with top plate 13. Preferably, the top plate is an extrusion fabricated of 6070 T6-E162 aluminum alloy or any of the other aluminum alloys or materials mentioned in my U.S. Pat. No. 2,805,859.

In a presently preferred springboard, the extruded top plate has a width of 19.49 inches between the outermost surfaces of outermost ribs 20 above the bulbed ends thereof; the distance between the top surface 15 and the lower ends of the bulbed major ribs 17–20 is 2.123 inches. The spacing between the ribs on either side of centerplane 21 is not uniform; in the preferred extrusion, ribs 17 and 18 are spaced on centers 1.77 inches apart, ribs 18 and 19 have their centers spaced 2.06 inches apart, and ribs 19 and 20 have center spacings of 2.16 inches.

As extruded, the top plate also defines a pair of minor ribs 24 which depend from the undersurface of the top plate, close to but on either side of center plane 21. The minor ribs are of lesser depth than the major ribs.

Figure 1:
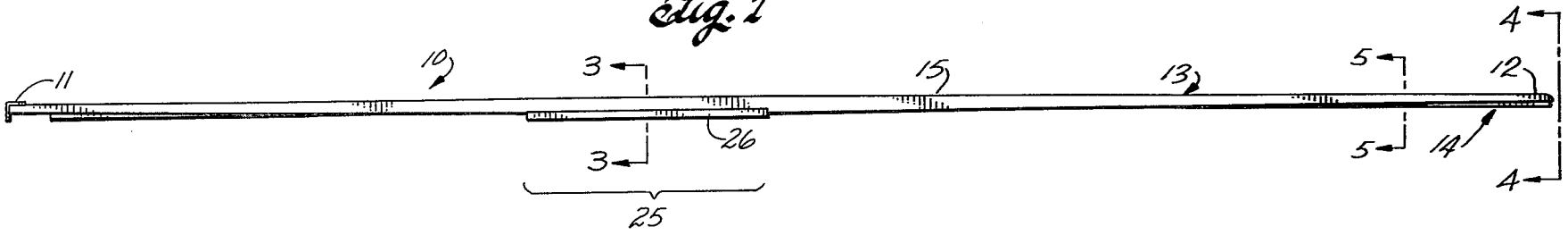
FIG. 1 is a side elevation view of a springboard according to this invention.

Springboard 10 preferably is used with a movable fulcrum assembly such as is shown in my prior Pat. Nos. 3,072,401 or 3,372,927. Accordingly, the location of the fulcrum, is not a precisely defined point relative to the base end of the board, but rather is a general area indicated at 25 in FIG. 1. In fulcrum area 25, the major ribs 17–20 have their full depth, but forwardly and rearwardly of the fulcrum area the ribs are progressively reduced in depth as shown in FIG. 1, more so toward the tip end of the board than toward its base end. In the fulcrum area, a resilient shoe 26 is engaged with the lower extremity of each of the major ribs. The shoes provide non-slip surfaces against which the rotatable drum-like fulcrum member may be driven to adjust the position of the fulcrum member toward or away from the base end of the springboard.

Channel-shaped torsion brace 14 is disposed along the centerplane of the board, and is suitably anchored to the underside of the top plate. Preferably, the anchoring of the brace to the top plate is rivets 27 which are countersunk into the top plate upper surface as shown in FIG. 3, for example. The torsion brace is of uniform cross-sectional configuration along its length and preferably, like the top plate is an extrusion. The torsion brace extends from a forward end, located very closely adjacent to the tip end of the diving board, to its rear end which is located between the fulcrum area 25 and the base end of the board.

Figure 7:
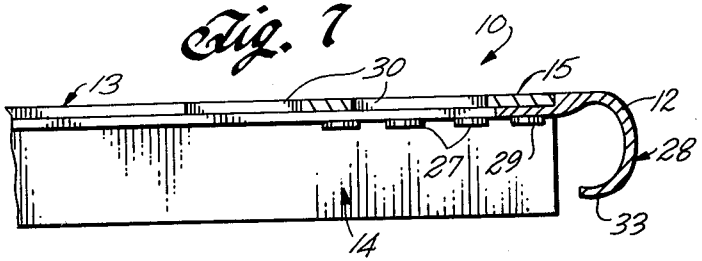
FIG. 7 is a fragmentary cross-sectional elevation view taken along line 7—7 in FIG. 4.

As shown in FIG. 7, the tip 12 of the board is defined by an extrusion 28 which extends across and is connected to the adjacent end of the top plate. Preferably this connection is made by rivets 29 (see FIG. 6) deposed along a line across the width of the board. Extrusion 28 defines a rolled lip 33 at the forward end of the board.

As shown in FIG. 1, the relief in the depth of major ribs 17–20 at and adjacent the board tip end is sufficient to cause the torsion brace 14 to project to below the lower ends of the ribs.

Springboard 10, as described to this point, is encountered in a commercially available springboard which is manufactured by Arcadia Air Products of Reno, Nevada, and which is sold worldwide under the trademarks DURAFLEX and DURAMAXIFLEX. Competition forms of such springboards are 16 feet in length, and other models are available in 14 foot lengths. It is these springboards which have been used exclusively in the Olympic Games and the Pan-American Games since 1959. They are preferred by competition divers for many reasons including uniformity of performance from board-to-board irrespective of temperature and humidity conditions. When these springboards are used by a skilled diver, the cantilevered portion of the board deflects substantially. As the diver makes his final stride along the board for his take-off, the tip end of the board deflects rapidly a very substantial amount and then rebounds rapidly back to and through its undeflected state, thereby to propel the diver upwardly from the board in the desired manner. It is because of the amplitude and velocity of these motions that aerodynamic drag effects act upon the board to, in effect, damp the motions of the board. This damping effect is greatest at the tip of the board and in the portions of the board adjacent to the tip.

Figure 2:
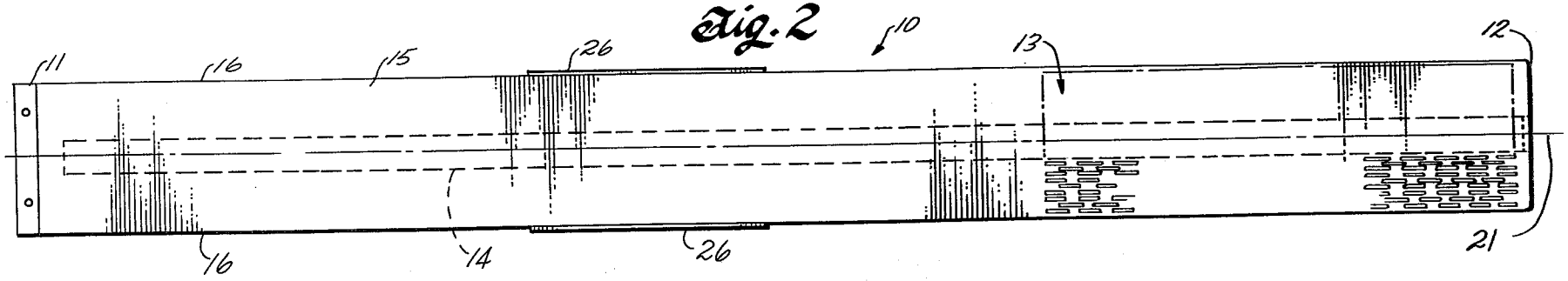
FIG. 2 is a top plan view of the springboard shown in FIG. 1.
Figure 6:
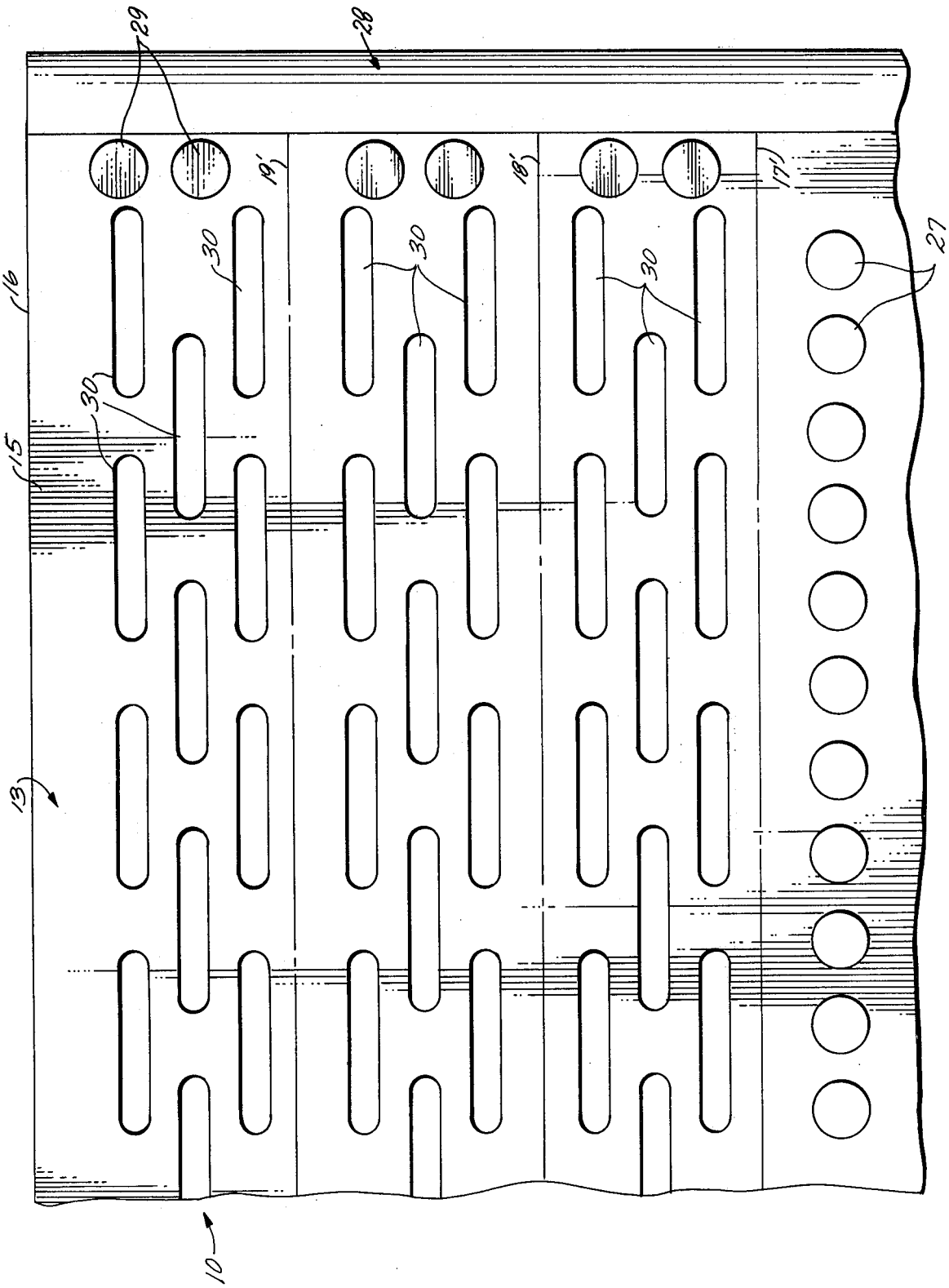
FIG. 6 is a fragmentary top plan view of the left front corner of the board.

In an improved diving board according to the present invention, these adverse aerodynamic drag effects are reduced by the provision in top plate 13 of a plurality of openings 30 which are formed through the top plate in a selected area of the board, which area is represented by broken line 31 in FIG. 2. Openings 30 preferably are elongate slot apertures which have their lengths aligned parallel to centerplane 21. Openings 30 are defined through the horizontal body portion of the top plate between ribs 17, 18, 19 and 20 as shown in FIGS. 5 and 6; in FIG. 6 the centerlines of ribs 17, 18 and 19 are represented by broken lines 17′, 18′ and 19′, respectively. Preferably, there are three rows of openings between each adjacent pair of ribs on either side of the centerplane so that, in each group of three rows of openings, the openings in the center row are staggered with respect to the aligned openings in the outer two rows (see FIG. 6). The pattern of holes between ribs 17 and 18 is centered between these ribs, and similarly with the pattern of holes between ribs 18 and 19. The pattern of holes between ribs 19 and 20, however, is disposed as close as possible to rib 19, rather than being centered.

I prefer to define the openings 30 in each row on two inch centers, and to space the rows on one-half inch centers. Also, I prefer to make the openings with semicircular ends, with the overall dimensions of the openings being one-fourth inch wide by $1\frac{1}{4}$ to $1\frac{1}{2}$ inch long. I have found that openings greater than one-fourth inch in width may permit the entry into the opening of the toes of a user, particularly a small child. Subject to considerations of avoiding pinching of toes and the like, the openings are made as large as possible to permit air to move as freely as possible through the board as the board is subjected to high amplitude, high velocity movements in use. Preferably, the perforated area 31 of the board commences approximately $1\frac{1}{2}$ inches rearwardly of the extreme tip end 12 of the diving board (just rearwardly of the connection of tip extension 28 to top plate 13) and has a length of approximately five feet along the board in the case of a 16-foot divers' springboard.

As shown in FIG. 5, the spaces between adjacent major ribs 17–20 on either side of centerplane 21 open downwardly from the board. Accordingly, openings 30 open entirely through the board and permit the free flow of air through the board in that portion of its length which is subjected to high amplitude motions in use. Air above and below the board is not required to flow entirely around the board in such a manner as to generate disadvantageous aerodynamic drag effects.

If desired, openings 35 may be provided through the top plate in the central portion of its width which is subtended by torsion brace 14; if so, similar openings 36 are formed through the torsion brace. In board 10, as shown in FIG. 5, a single row of openings 35, each having the same size as openings 30, is provided through the board immediately outwardly from each of minor ribs 24. Similar openings 36 are provided through the torsion brace directly below openings 35.

Figure 8:
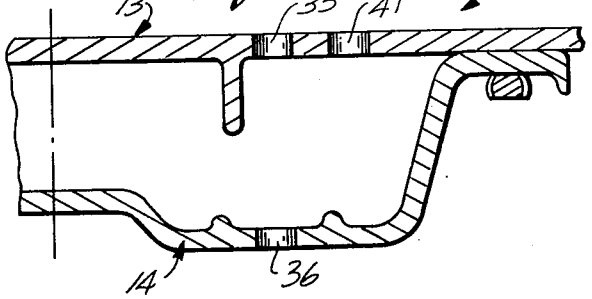
FIG. 8 is a fragmentary cross-sectional elevation view similar to that of FIG. 5 of another springboard according to this invention.

FIG. 8 shows another diving board 40 which is identical in all respects to diving board 10 except for the provision of an additional row of openings 41 through the top plate just outwardly from openings 35 in the portion of the top plate which is subtended by the torsion brace. Openings 35, 36 and 41 are identical.

The presence of openings 30, 35, 36 and 41 in a diving board according to this invention, in addition to reducing the damping drag effects of the board, also provides enhanced safety of the board. The openings facilitate drainage of water from the board top surface and provide enhanced traction between the board and the feet of a user, especially at the tip of the board where the action of divers' feet most quickly wear away whatever non-skid surfacing material may be present. A high-friction traction surface is still desired on the top of the board; it may be provided by grit or similar particles adhered to the board upper surface by a suitable adhesive paint or other coating.

Workers skilled in the art to which this invention pertains will appreciate that the drag reducing and drainage and traction enhancing openings may be provided through diving boards other than the particular diving board structures described above. The particular diving board arrangements described above constitute the presently preferred forms of this invention, which forms have been described in detail as required by applicable statutes. It will therefore be apparent that modifications, alterations and variations in the particular structural arrangements described above may be pursued in the practice of this invention without departing from its true scope. Accordingly, the preceding description should not be considered as limiting the scope of this invention.

What is claimed is:

1. A diving board comprising a top plate having a flat upper surface extending from a base end to a tip end of the board, a plurality of longitudinally extending spaced parallel ribs connected to the underside of the top plate and defining a plurality of downwardly opening longitudinal spaces, the ribs being displaced outwardly from either side of a longitudinal centerline of the top plate, and a plurality of openings formed through the top plate in a selected area of the top plate upper surface which extends from a location proximately adjacent the tip end of the board for a selected distance toward the base end of the board, the openings being formed through the top plate between the innermost ribs and the longitudinal edges of the top plate.

2. A diving board according to claim 1 wherein the openings are elongated in the direction of the centerline of the board.

3. The diving board according to claim 2 wherein the openings are essentially identical.

4. A diving board according to claim 2 wherein the openings have a width of substantially $\frac{1}{4}$ inch in a direction perpendicular to the centerline and a length of about $1\frac{1}{2}$ inches in a direction parallel to the centerline.

5. A diving board according to claim 4 wherein the openings are arranged in rows spaced about $\frac{1}{2}$ inch apart and the openings in each row are centered about 2 inches apart.

6. A diving board according to claim 4, wherein the openings are arranged in groups of plural rows between each adjacent pair of ribs, and the openings in each row of a group are staggered with respect to the openings in each adjacent row of the group.

7. A diving board according to claim 1 wherein the openings are arranged in groups of plural rows, and the openings in each row of a group are staggered with respect to the openings in each adjacent row of the group.

8. A diving board according to claim 1 wherein the selected area extends along the board for a distance less than one-half the length of the board.

9. A diving board according to claim 1 including an upwardly opening channel-shaped torsion brace anchored to the underside of the top plate and extending longitudinally thereof centrally between the innermost ones of the ribs, and openings through the top plate above the brace and through the brace.

10. In a metal diving board comprising a top plate having a flat upper surface extending from a base end to a tip end of the board, a plurality of longitudinally extending spaced parallel ribs connected to the underside of the top plate and defining a plurality of downwardly opening longitudinal spaces, the ribs being displaced outwardly from either side of a longitudinal centerline of the top plate, and an upwardly opening channel-shaped torsion brace anchored to the underside of the top plate and extending longitudinally thereof between the innermost ones of the ribs, the improvement comprising a plurality of elongate openings formed through the top plate in a selected area of the top plate upper surface which extends from a location proximately adjacent the tip end of the board toward the base end of the board for a distance which is less than one-half the length of the board, the opening being formed through the top plate between the innermost ribs and the longitudinal edges of the top plate, the openings having their elongate extents aligned parallel to the centerline.

11. A diving board having a substantially flat elongate upper tread surface extending from a base end to a tip end of the board and a bottom surface, and characterized by the presence in the board of a plurality of openings formed through the board in a selected area which extends from a location proximately adjacent the tip end of the board toward the base end of the board for a distance which is less than about one-half the length of the board, the openings being formed through the board so as to open to the upper and bottom surfaces of the board, the openings being elongated in the direction of the elongate extent of the board.

* * * * *